US006991103B2

(12) United States Patent
Chen

(10) Patent No.: US 6,991,103 B2
(45) Date of Patent: Jan. 31, 2006

(54) TOOLBOX

(75) Inventor: Mu-Yu Chen, Taichung (TW)

(73) Assignee: Aplus Pneumatic Corp., Taichung Hsien (TW)

( * ) Notice: Subject to any disclaimer, the term of this patent is extended or adjusted under 35 U.S.C. 154(b) by 20 days.

(21) Appl. No.: 10/642,306

(22) Filed: Aug. 14, 2003

(65) Prior Publication Data

US 2005/0045509 A1 Mar. 3, 2005

(51) Int. Cl.
*B65D 85/00* (2006.01)

(52) U.S. Cl. ..... 206/373; 206/379
(58) Field of Classification Search ..... 206/349, 206/379, 373, 759
See application file for complete search history.

(56) References Cited

U.S. PATENT DOCUMENTS

| | | | | |
|---|---|---|---|---|
| 3,259,748 | A * | 7/1966 | Lammers | 250/507.1 |
| 5,562,208 | A * | 10/1996 | Hasler et al. | 206/373 |
| 5,711,428 | A * | 1/1998 | Ho | 206/738 |
| 6,206,189 | B1 * | 3/2001 | Huot et al. | 206/379 |
| 6,415,923 | B1 * | 7/2002 | Chen | 206/379 |
| 6,547,074 | B1 * | 4/2003 | Chen | 206/379 |
| 6,547,077 | B1 * | 4/2003 | Budert | 206/754 |
| 6,615,983 | B1 * | 9/2003 | Yu | 206/372 |

* cited by examiner

*Primary Examiner*—John A. Ricci
(74) *Attorney, Agent, or Firm*—Charles E. Baxley

(57) ABSTRACT

A toolbox including two shells pivotally connected with each other and at least one tool holder pivotally connected with one of the shells for holding at least one tool. The at least one tool holder includes a shaft mounted on one of the shells and at least one socket mounted on the shaft for receiving a tool.

3 Claims, 11 Drawing Sheets

TOOLBOX

FIELD OF INVENTION

The present invention relates to a toolbox.

BACKGROUND OF INVENTION

Referring to FIG. 11, a toolbox includes two shells 40 connected with each other. Each shell 40 includes a space 41 defined therein and two series of tenons 42 formed thereon. The space 41 is located between the series of tenons 42. Several tool holders 20 are put in the space 41 so as to hold tools. Each end of each tool holder 20 defines at least one mortise 21 for receiving at least one of the tenons 42. The tool holders 20 lie on the shells 40. The tools also lie on the shells 40. However, it is inconvenient to take the tools from the tool holders 20 in such a position. Furthermore, the tenons 42 cannot be securely engaged with the mortises 21. The tool holders 20 can easily be detached from the shells 40 because of vibration. Thus, the tool holders 20 may fall on the ground when the toolbox is opened, and the tools may be detached from the tool holders 20 and dispersed. Therefore, the tool holders 20 and the tools may be damaged.

The present invention is therefore intended to obviate or at least alleviate the problems encountered in prior art.

SUMMARY OF INVENTION

The primary objective of the present invention is to provide a toolbox for convenient use.

According to the present invention, a toolbox including two shells pivotally connected with each other and at least one tool holder pivotally connected with one of the shells for holding at least one tool.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings.

DETAILED DESCRIPTION OF PREFERRED EMBODIMENT

Referring to FIGS. 1 to 6, according to a first embodiment of the present invention, a toolbox includes two shells 10 pivotally connected with each other and a plurality of tool holders 20 pivotally connected with each shell 10.

Figure 1:
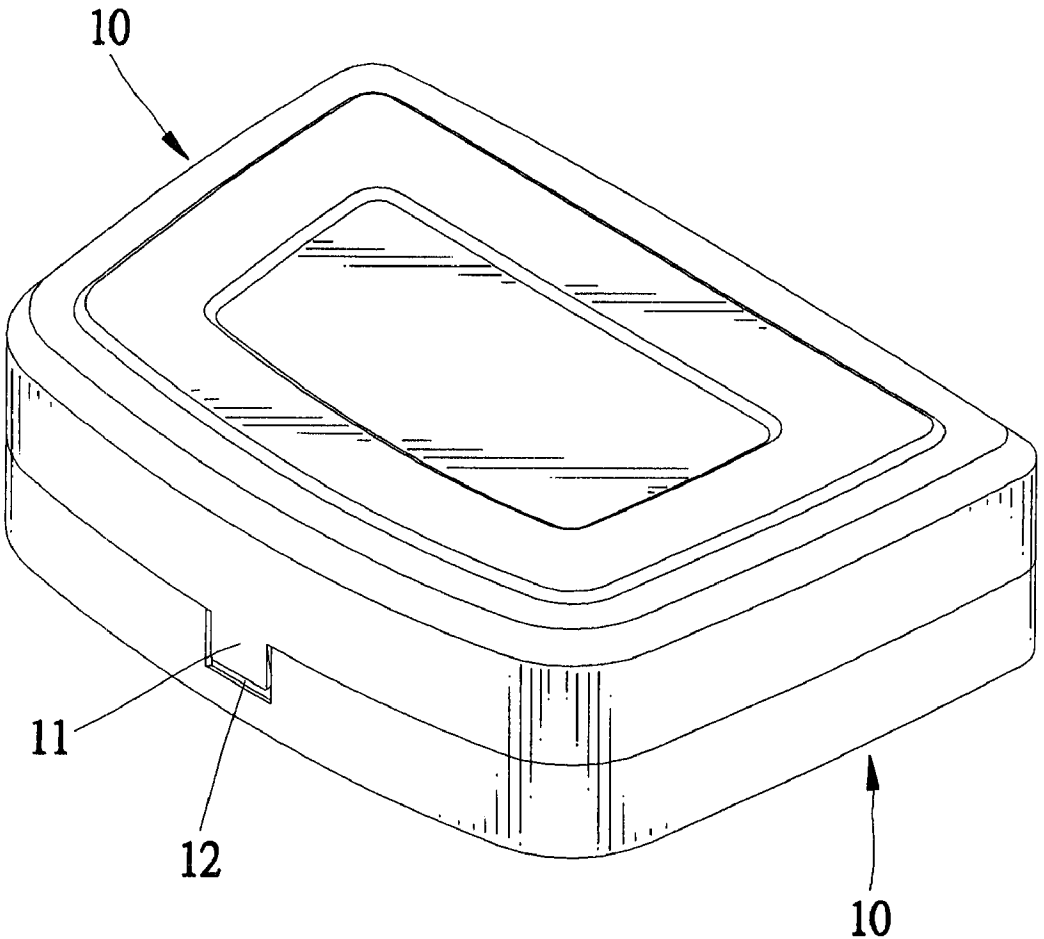
FIG. 1 is a perspective view of a toolbox according to a first embodiment of the present invention.
Figure 2:
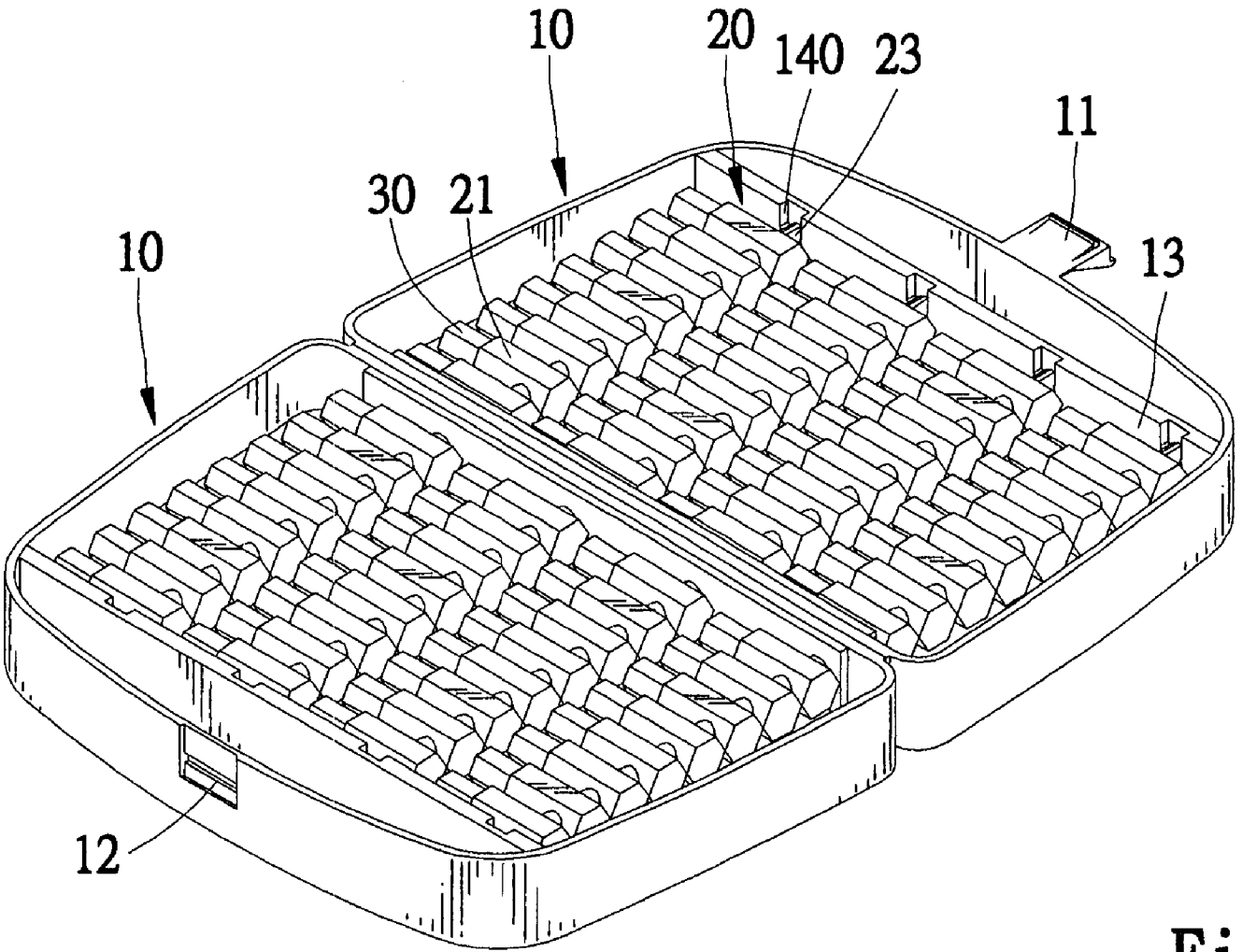
FIG. 2 is similar to FIG. 1 but showing the toolbox in an open position.
Figure 3:
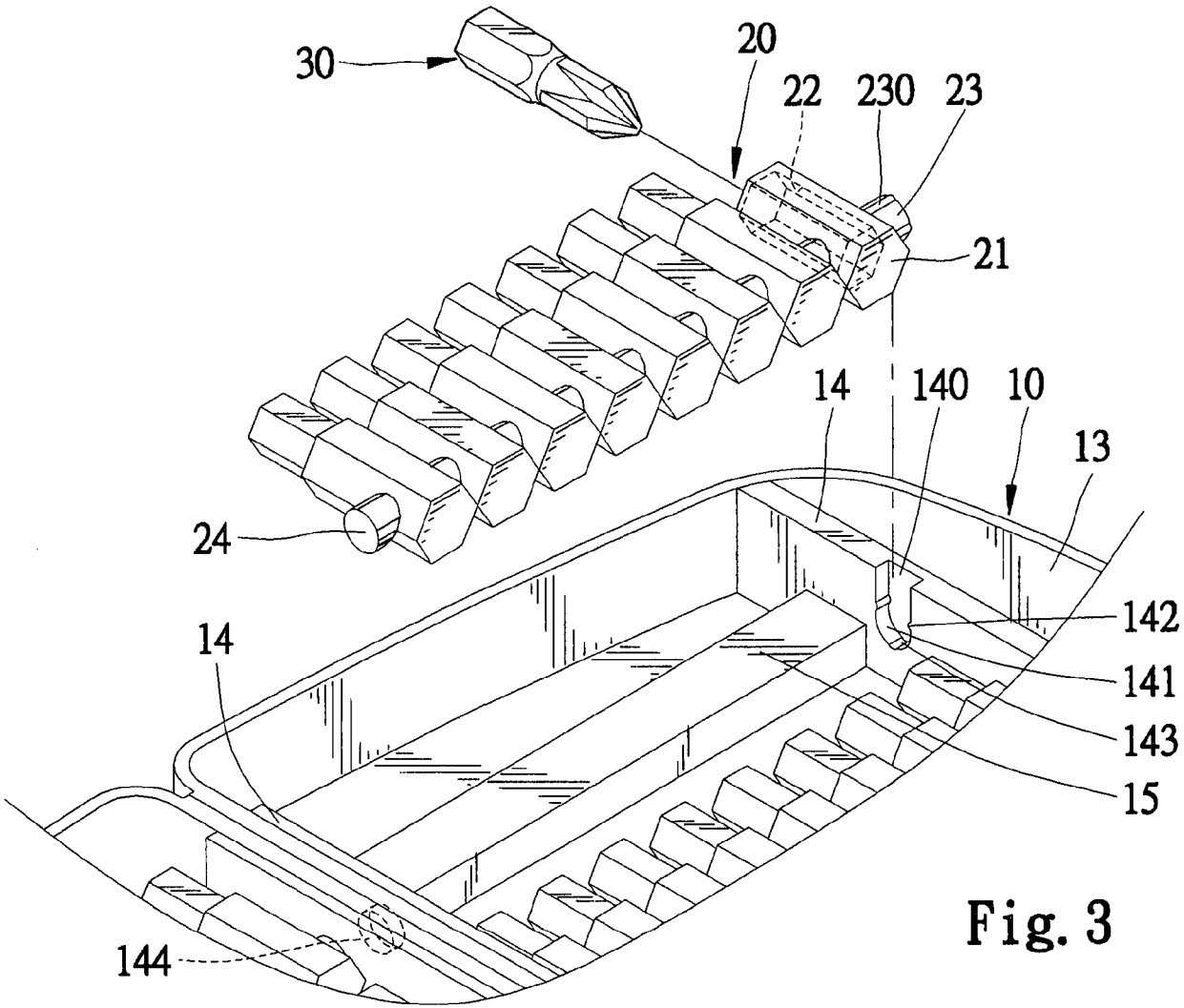
FIG. 3 is a partial perspective view of the toolbox of FIG. 2.

Referring to FIGS. 1–3, the toolbox includes a snap fastener 16 for closing the shells 10. The snap fastener 16 includes a flap 11 formed on one of the shells 10 and a hook 12 formed on the other of the shells 10 for engagement with the flap 11. Each shell 10 includes a space 13 defined therein and two reinforcement plates 14 formed thereon. One of the reinforcement plates 14 defines a plurality of pockets 140, and the other of the reinforcement plates 14 defines a plurality of holes 144. Each pocket 140 includes a semi-circular bottom 141. Two ridges 142 are formed on the bottom 141 of each pocket 140. A recess 143 is defined the bottom 141 of each pocket 140.

A plurality of positioning elements 15 is formed on each shell 10.

The tool holders 20 are separately arranged in each space 13. Each tool holder 20 includes a plurality of sockets 21 and a shaft 24 on which all the sockets 21 are mounted. Each socket 21 can receive a tool 30. Each shaft 24 includes a first end inserted in one hole 144 and a second end inserted in one pocket 140. Preferably, the second end of each shaft 24 is connected with a joint 23 that is inserted in one pocket 140. The joint 23 includes a plurality of detents 230 formed thereon.

Figure 4:
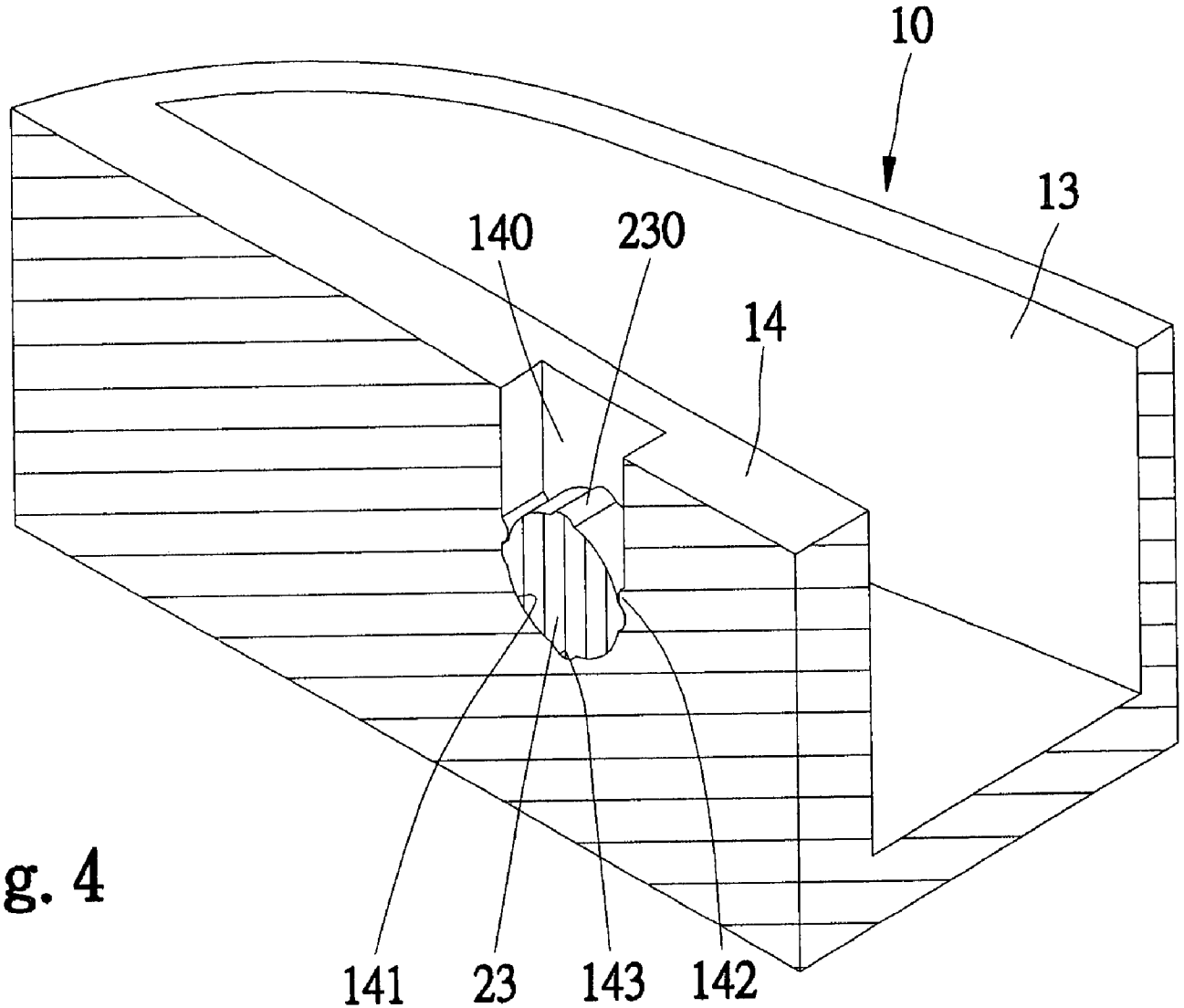
FIG. 4 is a cutaway view of the toolbox of FIG. 3.

FIG. 4 shows a pocket 140 receiving a joint 23. The ridges 142 of the pocket 140 retain the joint 23 in the pocket 140. Selective one of the detents 230 of the joint 23 enters the recess 143 of the pocket 140 so as to retain the joint 23 in position relative to the reinforcement plate 14.

Figure 5:
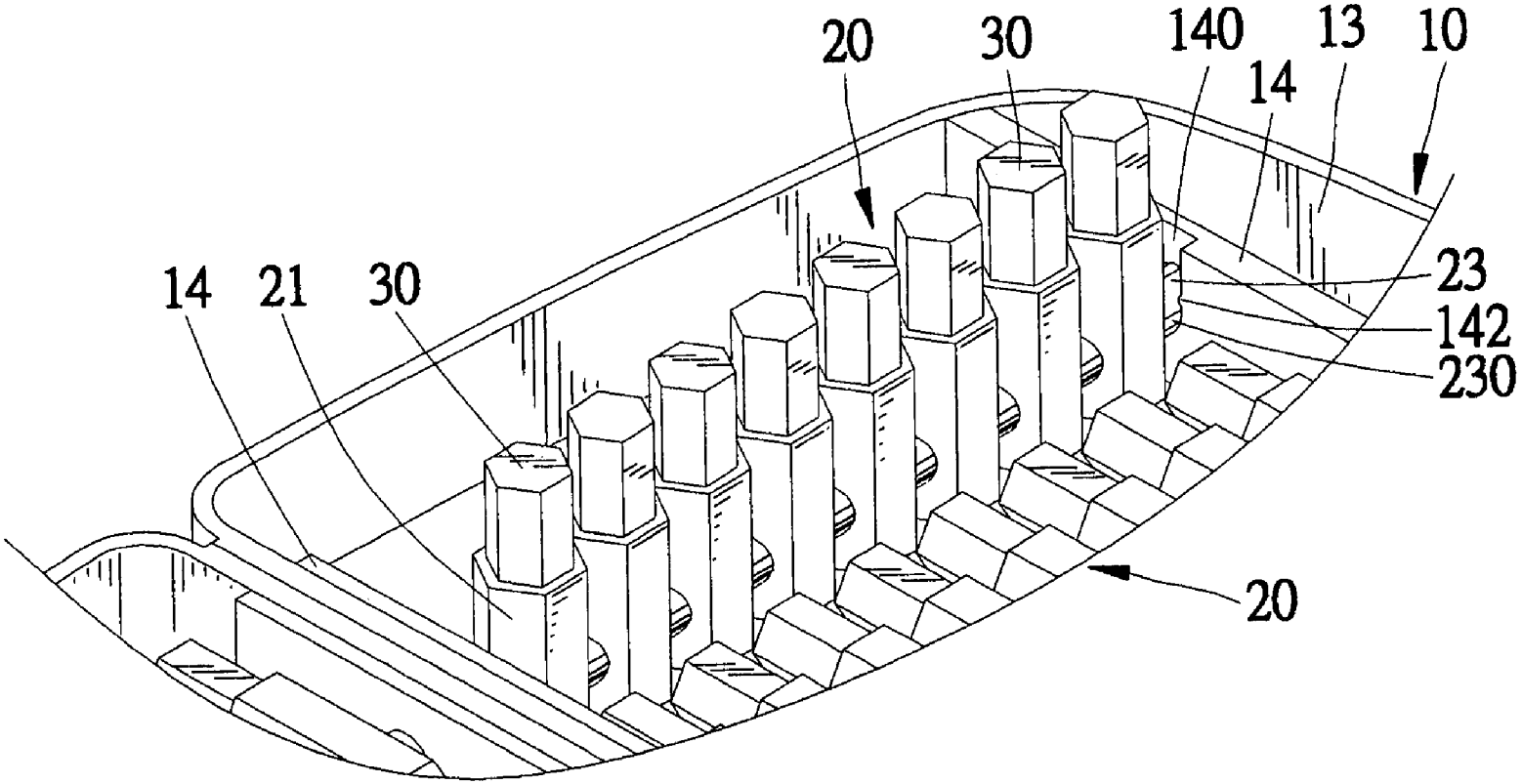
FIG. 5 is similar to FIG. 3 but showing tool holders in an operative position.
Figure 6:
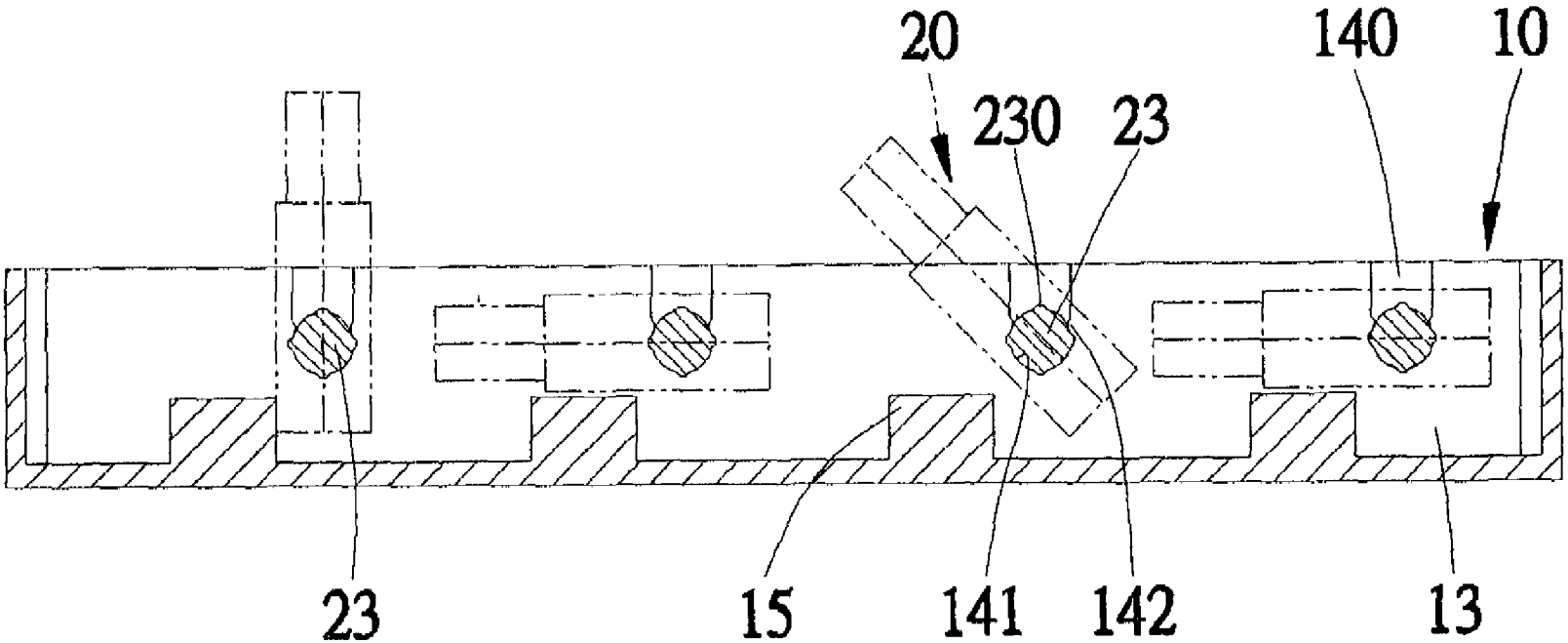
FIG. 6 is a cross-sectional view of the toolbox of FIG. 5.
Figure 7:
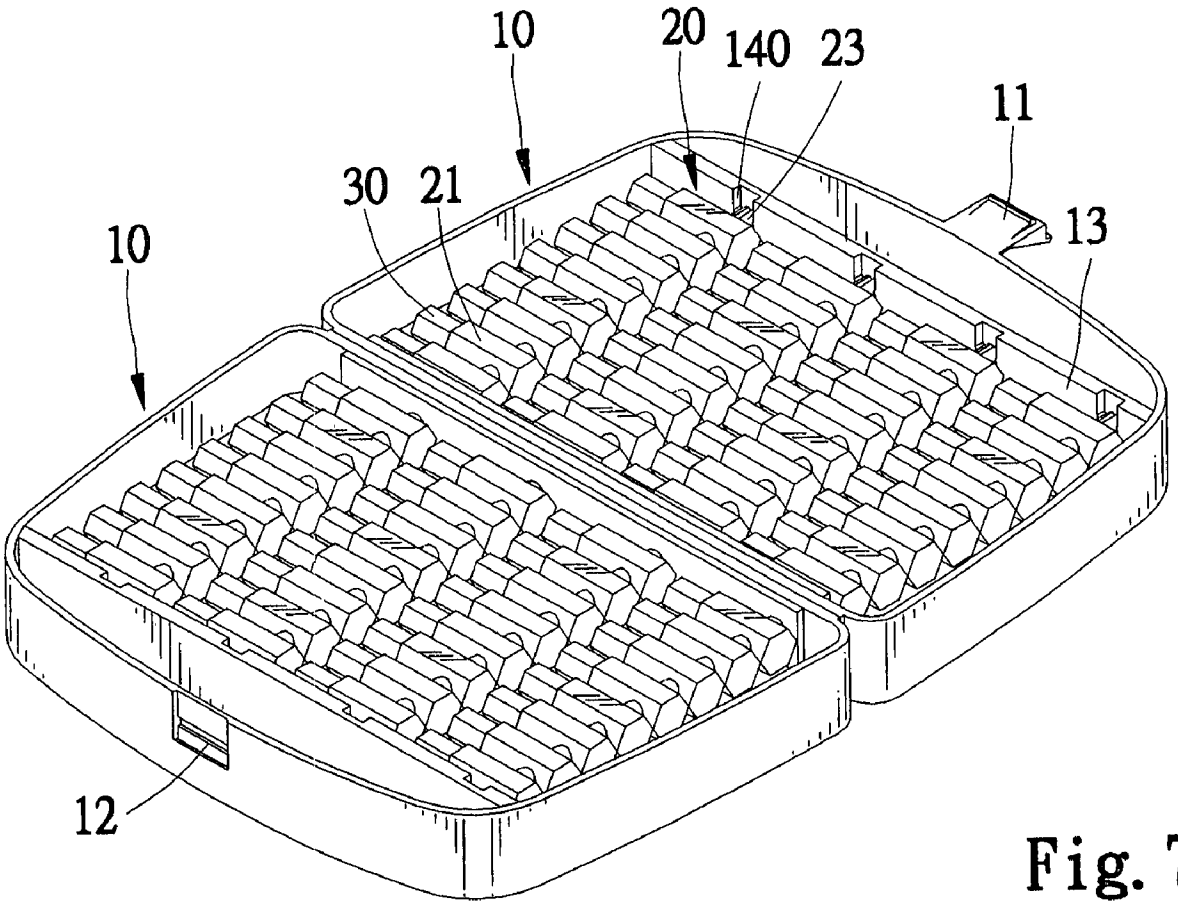
FIG. 7 is a perspective view of a toolbox according to a second embodiment of the present invention.
Figure 8:
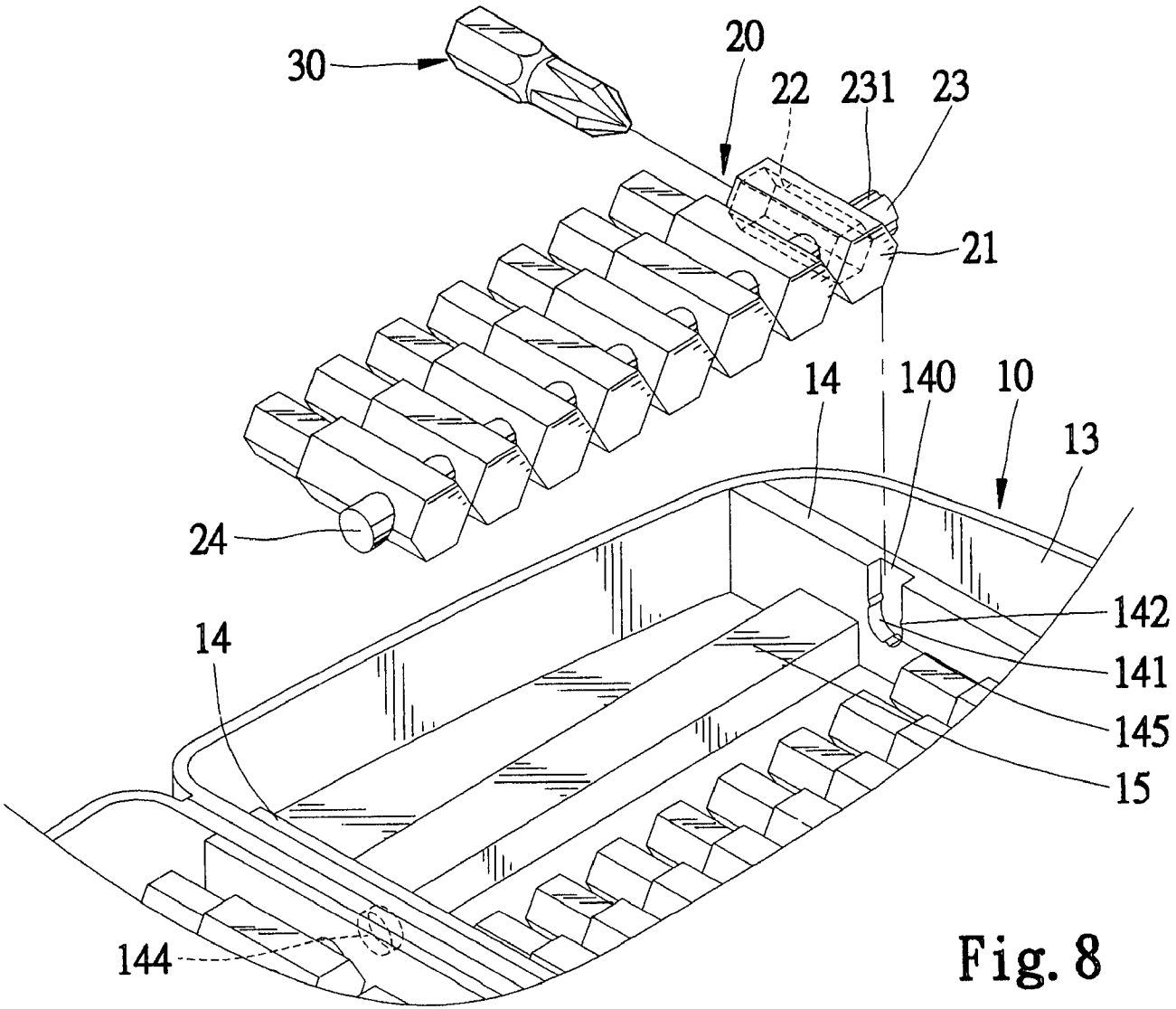
FIG. 8 is a partial perspective view of the toolbox of FIG. 7.
Figure 9:
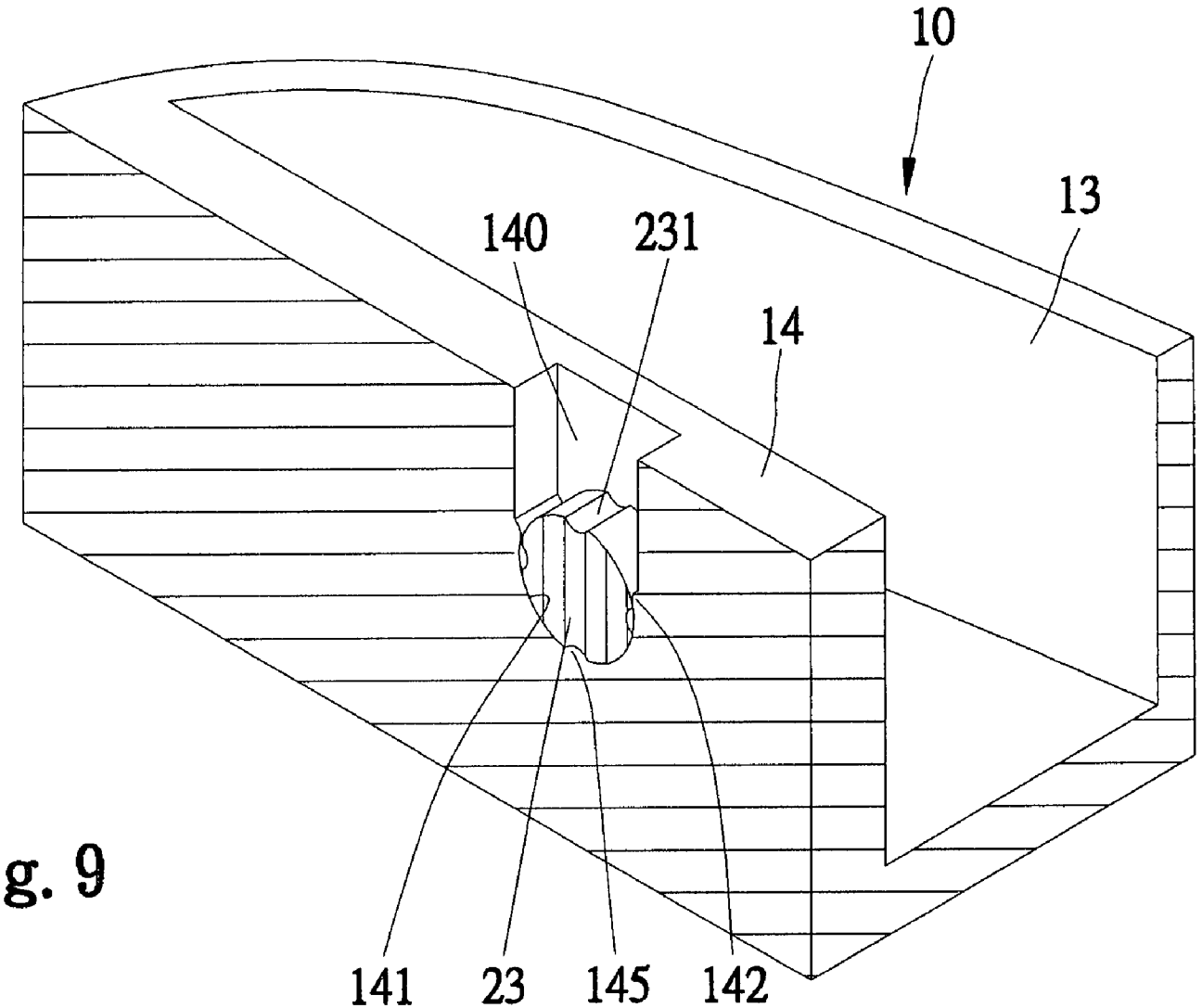
FIG. 9 is a cutaway view of the toolbox of FIG. 8.
Figure 10:
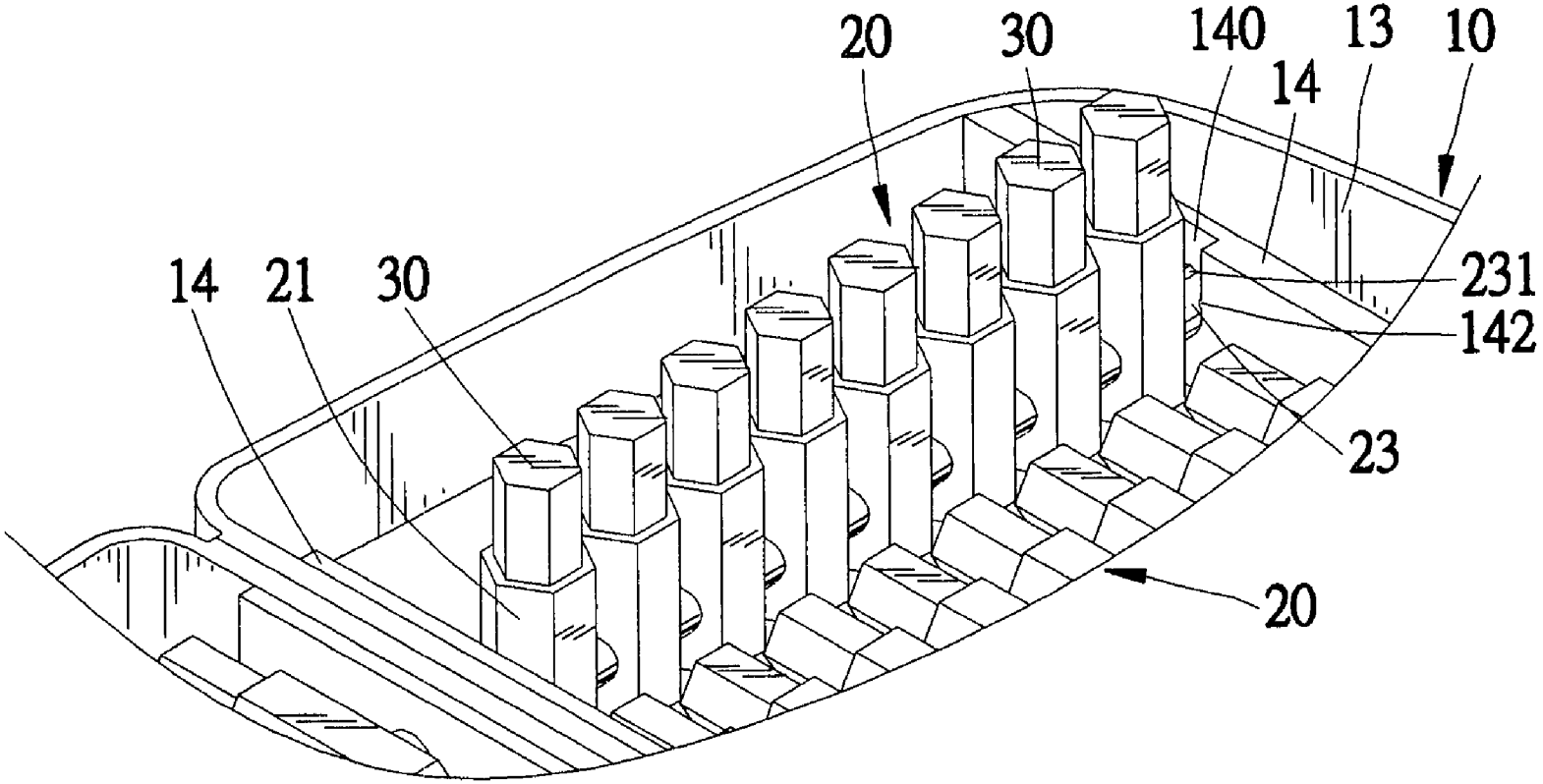
FIG. 10 is similar to FIG. 8 but showing tool holders in an operative position.
Figure 11:
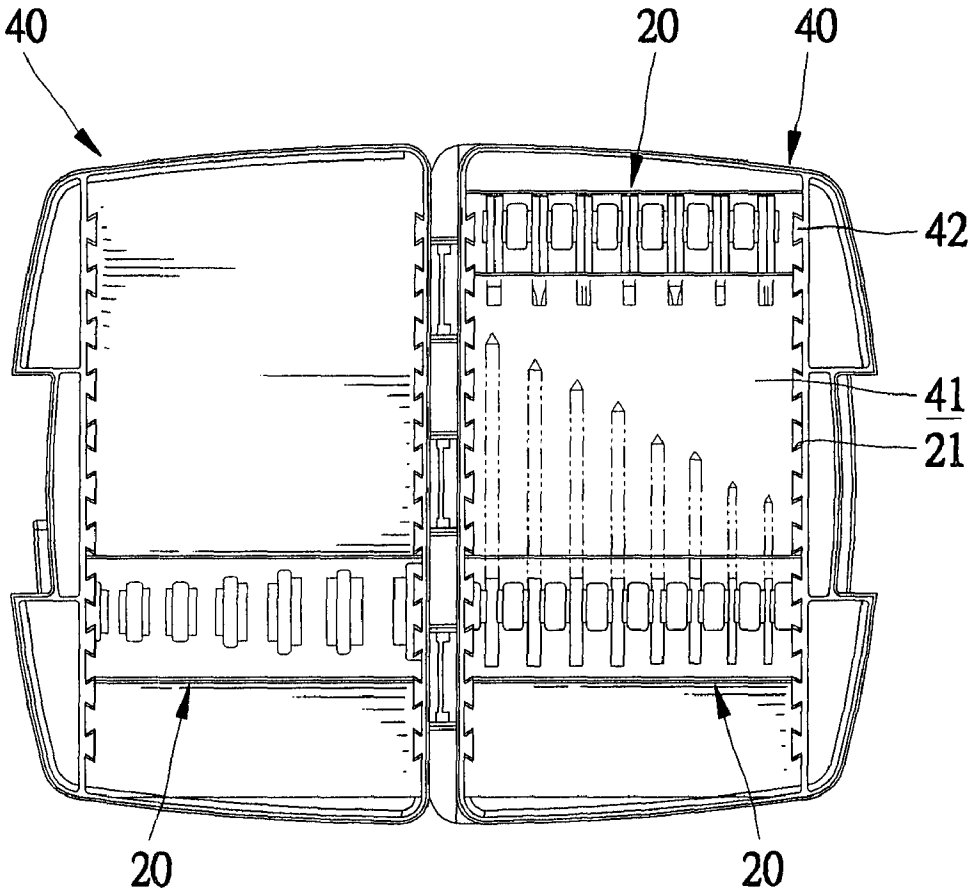
Fig. 11 PRIOR ART
FIG. 11 is a top view of a conventional toolbox.

FIGS. 5 and 6 show a tool holder 20 is in an upright position, a tool holder 20 in a tilted position and two tool holders 20 lying on two positioning elements 15. A positioning element 15 abuts and retains in position the tool holder 20 that is in the upright position.

As discussed above, each tool holder 20 and related tools 30 can be put in desired one of several positions. Therefore, it is convenient to take the tools 30 from the tool holder 20.

FIGS. 7 to 10 show a second embodiment according to the present invention. The second embodiment is identical to the first embodiment except that each dent 230 is replaced with a recess 231, and each recess 143 is replaced with a dent 145.

The present invention has been described through detailed illustration of two embodiments. Those skilled in the art can derive variation from the embodiments without departing from the scope of the present invention. Therefore, the embodiments shall not limit the scope of the present invention defined in the claims.

What is claimed is:

1. A toolbox including two shells pivotally connected with each other and at least one tool holder pivotally connected with one of the shells for holding at least one tool, wherein the at least one tool holder includes a shaft mounted on one of the shells and at least one socket mounted on the shaft for receiving a tool, wherein one of the shells includes two reinforcement plates formed thereon for supporting the shaft, wherein first one of the reinforcement plates defines a hole for receiving a first end of the shaft and second one of the reinforcement plates defines a pocket for receiving a second end of the shaft and wherein the pocket includes two ridges formed therein for retaining the second end of the shaft in the pocket.

2. A toolbox includes two shells pivotally connected with each other and at least one tool holder pivotally connected with one of the shells for holding at least one tool, wherein the at least one tool holder includes a shaft mounted on one of the shells and at least one socket mounted on the shaft for receiving a tool, wherein one of the shells includes two reinforcement plates formed thereon for supporting the shaft, wherein first one of the reinforcement plates defines a hole for receiving a first end of the shaft and second one of the reinforcement plates defines a pocket for receiving a second end of the shaft, further comprising a joint connected with the second end of the shaft and put in the pocket, and wherein the pocket includes two ridges formed therein for retaining the joint in the pocket.

3. A toolbox including two shells pivotally connected with each other and at least one tool holder pivotally connected with one of the shells for holding at least one tool wherein one of the shells includes at least one positioning element formed thereon for supporting at least one tool both in an upright position and a lying position relative thereto.

* * * * *